United States Patent [19]

Lucchitta

[11] 4,084,702

[45] Apr. 18, 1978

[54] PORTABLE STORAGE APPARATUS

[76] Inventor: Elio Lucchitta, 106A Main St., Hillsburgh, Ontario, Canada

[21] Appl. No.: 786,469

[22] Filed: Apr. 11, 1977

[51] Int. Cl.[2] ..... A47F 5/08

[52] U.S. Cl. ..... 211/88; 211/184; 312/245; 312/346

[58] Field of Search ..... 211/88, 126, 184, 94; 312/245, 346; 108/108, 152; 248/247; 220/23.4; 296/37.6

[56] References Cited

U.S. PATENT DOCUMENTS

| | | | |
|---|---|---|---|
| 1,352,924 | 9/1920 | Streich | 312/346 |
| 2,226,434 | 12/1940 | Hirsh | 312/346 |
| 2,601,069 | 6/1952 | Strumbos | 312/245 |
| 2,732,954 | 1/1956 | Janonis et al. | 211/88 |
| 3,097,746 | 7/1963 | Handler et al. | 108/108 |
| 3,307,709 | 3/1967 | Hulterstrum | 220/23.4 |
| 3,656,786 | 4/1972 | Larson | 211/184 |
| 3,726,411 | 4/1973 | Jones | 211/126 |

FOREIGN PATENT DOCUMENTS

| | | | |
|---|---|---|---|
| 719,558 | 10/1965 | Canada | 211/126 |

*Primary Examiner*—Paul R. Gilliam
*Assistant Examiner*—Victor N. Sakran
*Attorney, Agent, or Firm*—Robert D. Farkas

[57] ABSTRACT

A portable storage apparatus utilizes an elongated sheet carrying a plurality of spaced apart plates, each of whom is provided with a pair of tracks extending outwardly from the sheet. A carrying/storage container is provided with at least a pair of rails adapted to be slideably removably engaged within adjacent tracks such that the container, resting upon an elongated lip of the sheet, disposes the open mouth portion of the container in an uppermost position. Openings in the container are utilized to transport the container from place to place. The container is provided with inwardly directed excursions in opposed side walls thereof enabling U-shaped container divider sheets, having complementary grooves therein, to be removably installed within the storage area of the container.

4 Claims, 3 Drawing Figures

PORTABLE STORAGE APPARATUS

BACKGROUND OF THE INVENTION

1. The Field of the Invention

This invention relates to storage containers, tool boxes, utility bins and the like, and apparatus adapted to removably mount same to a vertical supporting surface.

2. Description of the Prior Art

The prior art abounds with storage containers and their mounting means. Typical of these is the track body with suspension rack taught in U.S. Pat. No. 3,826,529 issued on July 30, 1974 to R. J. Wood which discloses a rack for tools or the like for use on an automotive vehicle. The rack is in the form of a cabinet and supported on a track extending along the length of the vehicle, located outwardly from the center line thereof. The rack can be pulled completely from the vehicle to provide access to the contents of the rack.

U.S. Pat. No. 2,226,434 issued Dec. 24, 1940 to M. H. Hirsk discloses a box to be installed in compartments of a motor vehicle, utilizing a pair of tracks whose spacing is adjustable. A pair of rails are affixed to the box for slideable engagement along the length of the pair of tracks.

Both of the aforementioned patents suffer the common deficiency of providing a mounting means for only one cabinet or box rather than an apparatus suitable for independent mounting and easy dismounting of a plurality of containers to a supporting elongated sheet.

SUMMARY OF THE INVENTION

A primary object of the present invention is to provide a secure mounting structure for a plurality of containers, which when carried by the mounting structure, are disposed in side by side relationship, each being separately mountable and dismountable to the structure.

Another object of the present invention is to provide a storage container which may be conveniently installed on and removed from a mounting apparatus.

Yet another object of the present invention is to provide a storage container which may be divided into compartments at the will of the user.

Artisan's vehicles, such as telephone installers and repairmen vans, plumber's vans, electricians' trucks and the like, each carry about, quantities of diverse types of supplies. Prior efforts to fabricate storage compartments and containers reside primarily in the art areas concerning drawers and bins. The present invention recognizes the need of the aforementioned artisans to carry portions of their supplies from the vehicle transporting them to the work sight. Furthermore, it is necessary to periodically replenish the contents of such storage devices, further increasing the need to conveniently remove the storage device, transporting same to a supply area.

The present invention envisions the installation of a plurality of separate containers, each independently mounted and removable from an elongated sheet secured to a vertical mounting surface, such as the interior vertical wall of a van or a vertical wall in a supply room of a factory. A plurality of such elongated sheets may be disposed one above the other so as to increase the storage efficiency of the vertical wall.

These objects as well as other objects of the present invention, will become more readily apparent after reading the following description of the accompanying drawings.

DESCRIPTION OF THE PREFERRED EMBODIMENT

Figure 1:
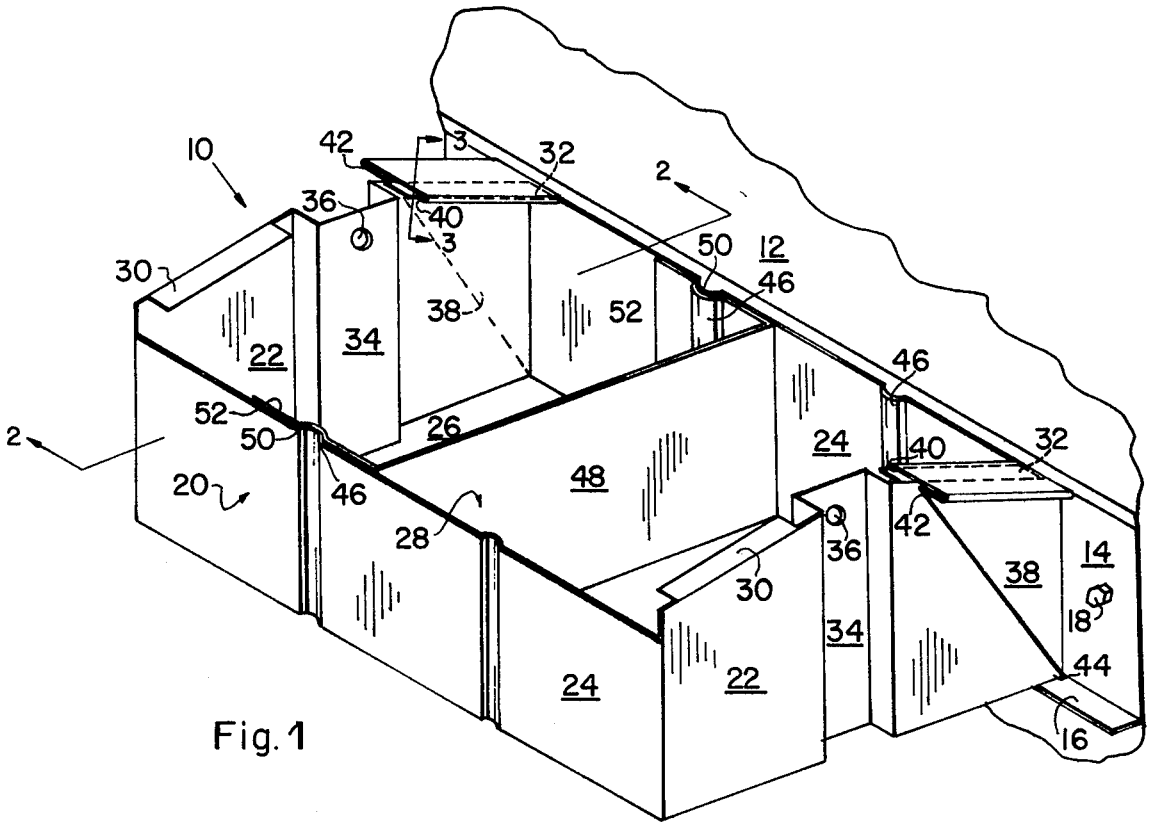
FIG. 1 is a perspective view of the present invention.

The structure and method of fabrication of the present invention is applicable to a five sided rectangular container, four sides of which define walls adjacent an open mouth portion, the fifth side of which defines a base. It should be specifically understood that the base portion need not be at right angles to all of the walls, nor that the mouth portion be planar nor parallel with the base portion. Two rails are affixed to each of a pair of opposed walls at the marginal edges thereof adjacent the open mouth portion and are directed inwardly towards the opposed side wall. Each of the pair of rails on either opposed side wall are at angles to one another defining downwardly directed lines whose intersection forms the apex of an isosceles triangle. Each of the opposed pair of side walls having the rails affixed thereto carries an opening for use in transporting the container from place to place. The opening is in a portion of the side walls which is disposed inwardly towards the center of the container.

Each of the other pair of opposed side walls are provided with a plurality of upwardly extending inwardly directed protrusions. A U-shaped sheet, having inwardly directed grooves on the leg portions thereof, is adapted to serve as a compartment dividing wall by having the grooves slideably engage the protrusions on the container walls. Cross dividers may be utilized, if desired, in conventional fashion.

An elongated sheet, having one marginal edge thereof turned outwardly so as to provide a lip or shelf, is secured to a vertical mounting surface, on a vehicle or on a stationary wall, utilizing conventional mounting means, such as bolts passing through openings in the elongated sheet. The lip or shelf is disposed in a lowermost horizontal position when the elongated sheet is secured to the mounting surface. A plurality of plates are affixed, in spaced apart parallel relationship to the mounting sheet and extend outwardly normal thereto and outwardly from the mounting surface. Each plate is provided with a pair of oppositely directed tracks running parallel to one another, extending alongst an uppermost marginal edge of the plate to which they are affixed defining a pair of tracks disposed upwardly and outwardly from the uppermost longitudinal marginal edge of the elongated sheet.

The container is mounted to adjacent plates by having a pair of opposed adjacent rails slideably engage within the tracks disposed intermediate the adjacent plates. The container may be mounted in reverse position, if desired, by utilizing the other pair of rails so as to selectively rotate the container prior to mounting on the elongated sheet. It should be specifically understood that portions of the lowermost base-like surface of the removable container may if desired rest upon the lip or shelf formed in the lower regions of the elongated sheet, so as to provide additional support to the container. The lip or shelf may extend, if desired, supporting the entire outermost surface area of the base.

Now referring to the Figures and more particularly to the embodiment illustrated in FIG. 1 showing the present invention 10 shown attached to a supporting surface 12, which is vertical. Elongated sheet 14 is provided with an elongated lip or shelf 16 extending along the lowermost regions thereof. Bolt 18 passes through an opening, not shown, securing elongated sheet 14 to mounting surface 12. Container 20 is fabricated having a pair of opposed side walls 22 and a pair of adjacent side walls 24, defining a rectangular shape. Base 26 is secured to walls 22 and 24, forming a substantially five sided container having an open mouth portion 28. Side walls 22 are each provided with inwardly directed rails 30 and angularly displaced inwardly directed rails 32. A portion 34 of side walls 22 are displaced inwardly from the outermost surface of walls 22 so as to facilitate manual grasping of container 20 utilizing openings 36 therefor.

Plates 38 are attached to elongated sheet 14 and are provided with tracks 40 and 42. Tracks 40 and 42 extend outwardly and upwardly from supporting surface 12. As shown, rails 32 are disposed within tracks 40 whilst tracks 42 are shown empty. An additional container, not shown, may be partially supported within tracks 42 in similar fashion as container 20 is shown supported by rails 32 confined within track 40. A portion of the lowermost surface 44 of container 20 is shown resting on lip or shelf 16.

Walls 24 are provided with protrusions 46 extending in a vertical direction, adapted to slideably retain U-shaped compartment divider sheet 48 within the container 20 by having grooves 50 formed in the legs 52 of divider 48 slideably engage protrusions 46.

Figure 2:
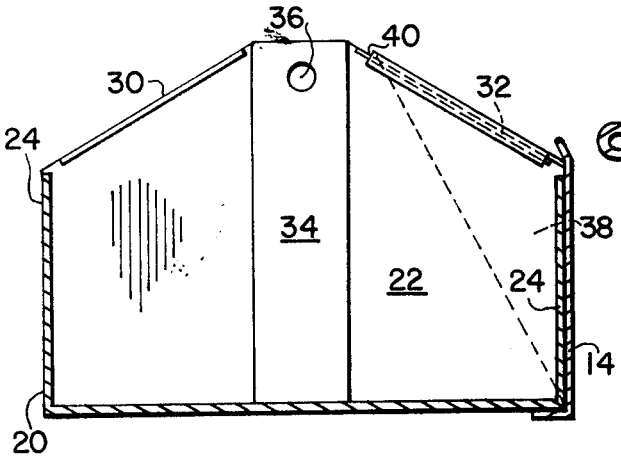
FIG. 2 is a side elevation cross-sectional view taken through line 2—2 viewed in the direction of arrows 2—2 as shown in FIG. 1.

FIG. 2 illustrates plate 38 to which track 40 is affixed, container rail 32 therein. Rail 30 and rail 32 are angularly displaced to one another so as to insure that container 20 will not accidentally dislodge from a mounted position to elongated sheet 14, when either rail 32 or rail 30 is captured within track 40.

Figure 3:
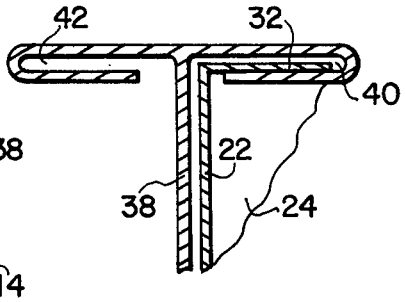
FIG. 3 is a front elevation cross-sectional view taken along line 3—3 viewed in the direction of arrows 3—3 as shown in FIG. 1.

FIG. 3 shows plate 38 to which tracks 40 and 42 are affixed. Wall 22 is shown carrying rail 32, disposed within the confines of track 40 and supported thereby.

One of the advantages of the present invention is a secure mounting structure for a plurality of containers, which when carried by the mounting structure, are disposed in side by side relationship, each being separately mountable and dismountable to the structure.

Another advantage of the present invention is a storage container which may be conveniently installed on and removed from a mounting surface.

Still another advantage of the present invention is a storage container which may be divided into compartments at the will of the user.

Thus there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

I claim:

1. A portable storage apparatus comprising an elongated sheet, means to secure said sheet to a vertical supporting surface, a plurality of plates, each of said plurality of plates fixedly secured to and extending substantially normally outwardly from said sheet in spaced apart parallel relationship, each of said plurality of plates having a track fixedly secured to a marginal edge thereof, a container, said container having an open mouth portion, said container having at least a pair of elongated rails fixedly secured thereto adjacent said open mouth portion thereof, wherein said rails are removably slideably engaged within said track of an adjacent pair of plates disposing said open mouth portion in an uppermost position.

2. The portable storage apparatus as claimed in claim 1 wherein said container further comprises a plurality of inwardly directed protrusions disposed in parallel spaced apart relationship from one another on opposed walls of said container, a U-shaped sheet, said U-shaped sheet having a pair of grooves, each of said grooves being located on the leg portions of said U-shaped sheet, each of said grooves for slidably removably engaging one of said plurality of protrusions.

3. The portable storage apparatus as claimed in claim 1 wherein said container comprises a rectangular box having four walls and a base, two of said four walls being opposed to one another and carrying said at least a pair of elongated rails, each of said two walls having an opening therein, whereby said opening is disposed adjacent the marginal edge of said two walls adjacent said open mouth portion.

4. The portable storage apparatus as claimed in claim 1 further comprising said elongated sheet having a lip extending along the length thereof, said lip providing a resting surface for said container when one of said elongated rails is disposed within one of said tracks.

* * * * *